US010697264B2

(12) United States Patent
Witwer et al.

(10) Patent No.: US 10,697,264 B2
(45) Date of Patent: Jun. 30, 2020

(54) SUBSEA SYSTEM AND METHOD FOR HIGH PRESSURE HIGH TEMPERATURE WELLS

(71) Applicant: Dril-Quip Inc., Houston, TX (US)

(72) Inventors: Bruce Joseph Witwer, Aberdeen (GB); Justin Edward Morse, Houston, TX (US); Daniel J. McLaughlin, Katy, TX (US); Gregory Dale Williams, Houston, TX (US); James R. Bower, Deer Park, TX (US)

(73) Assignee: Dril-Quip Inc., Houston, TX (US)

( * ) Notice: Subject to any disclaimer, the term of this patent is extended or adjusted under 35 U.S.C. 154(b) by 0 days.

(21) Appl. No.: 16/543,414

(22) Filed: Aug. 16, 2019

(65) Prior Publication Data

US 2019/0368298 A1 Dec. 5, 2019

Related U.S. Application Data

(63) Continuation-in-part of application No. 15/274,329, filed on Sep. 23, 2016, now Pat. No. 10,392,907.

(60) Provisional application No. 62/233,027, filed on Sep. 25, 2015.

(51) Int. Cl.
*E21B 33/035* (2006.01)
*E21B 43/013* (2006.01)
(Continued)

(52) U.S. Cl.
CPC ..... *E21B 33/0355* (2013.01); *E21B 17/01* (2013.01); *E21B 43/013* (2013.01);
(Continued)

(58) Field of Classification Search
CPC .. E21B 33/0355; E21B 33/043; E21B 33/064; E21B 17/01; E21B 43/013; E21B 34/045; E21B 34/16; E21B 41/0007
(Continued)

(56) References Cited

U.S. PATENT DOCUMENTS 8,161,993 B2 4/2012 Ratcliffe
2010/0025044 A1 2/2010 McKay et al.
(Continued)

FOREIGN PATENT DOCUMENTS

EP 2236741 A2 10/2010
WO 2015085200 A1 6/2015

OTHER PUBLICATIONS

Kaculi, Jim. "Next Generation HPHT Subsea Wellhead Systems Design Challenges and Opportunities." In Offshore Technology Conference. Offshore Technology Conference, 2015.
(Continued)

*Primary Examiner* — Anna M Momper
*Assistant Examiner* — Patrick F Lambe
(74) *Attorney, Agent, or Firm* — Baker Botts L.L.P.

(57) ABSTRACT

A subsea production system and method for installing the same are provided. The subsea production system includes a high pressure subsea wellhead, a tubing hanger landed proximate the wellhead, a production tree disposed above the wellhead downstream of the tubing hanger, a riser, a subsea flowline system coupled between the production tree and the riser, at least one barrier located downstream of the tubing hanger, and a secondary barrier valve disposed within the tubing hanger or in line with and upstream of the tubing hanger. The at least one barrier provides a pressure barrier that controls pressure of fluid flowing from components of the subsea production system located upstream of the barrier to components of the subsea production system located downstream of the barrier, and the secondary barrier valve is remotely actuable between a closed position and an open position.

18 Claims, 11 Drawing Sheets

(51) Int. Cl.

| | |
|---|---|
| ***E21B 17/01*** | (2006.01) |
| *E21B 41/00* | (2006.01) |
| *E21B 33/064* | (2006.01) |
| *E21B 34/04* | (2006.01) |
| *E21B 34/16* | (2006.01) |
| *E21B 33/043* | (2006.01) |

(52) U.S. Cl.
CPC ..... *E21B 33/043* (2013.01); *E21B 33/064* (2013.01); *E21B 34/045* (2013.01); *E21B 34/16* (2013.01); *E21B 41/0007* (2013.01)

(58) Field of Classification Search
USPC ..... 166/339
See application file for complete search history.

(56) References Cited

U.S. PATENT DOCUMENTS

| | | | | |
|---|---|---|---|---|
| 2011/0240157 | A1 | 10/2011 | Jones et al. | |
| 2012/0138159 | A1 | 6/2012 | Wordley et al. | |
| 2014/0060850 | A1 | 3/2014 | Voss et al. | |
| 2015/0354308 | A1* | 12/2015 | June | E21B 33/0407 166/65.1 |

OTHER PUBLICATIONS

Search Report issued in related GB Application No. 1616205.9, dated Jan. 30, 2017 (3 pages).

* cited by examiner

SUBSEA SYSTEM AND METHOD FOR HIGH PRESSURE HIGH TEMPERATURE WELLS

CROSS REFERENCE TO RELATED APPLICATIONS

The present application is a continuation-in-part of U.S. patent application Ser. No. 15/274,329, entitled "Subsea System and Method for High Pressure High Temperature Wells," filed on Sep. 23, 2016, which claims priority to U.S. provisional application Ser. No. 62/233,027, entitled "Subsea System and Method for High Pressure High Temperature Wells," filed on Sep. 25, 2015.

TECHNICAL FIELD

The present disclosure relates generally to subsea well systems and methods and, more particularly, to subsea well systems and methods for production and intervention on high pressure high temperature (HPHT) wells.

BACKGROUND

Offshore oil and gas operations typically involve drilling a wellbore through a subsea formation and disposing a wellhead at the upper end of the well (e.g., at the mudline). A string of casing can be landed in the wellhead, and a tubing spool is generally connected to the top of the wellhead. A tubing hanger lands in the tubing spool, and the tubing hanger suspends a production tubing string through the wellhead and tubing spool into the casing string. A conventional production tree can be connected to the top of the tubing spool to route product from the tubing hanger (and production tubing) toward a production riser. The production riser generally includes a series of riser pipes connected end to end to connect the subsea production components to, for example, a topside production facility. Such subsea systems are often used to extract production fluids from subsea reservoirs.

Recently, the oil and gas industry has begun to see increased activity and interest in developing a wider variety of offshore reservoirs. Specifically, there is an increased interest in developing high pressure high temperature (HPHT) subsea reservoirs. The term HPHT refers to wells that have mudline pressures in excess of 15,000 psi, temperatures in excess of 350 degrees F., or both. In an effort to develop such HPHT reservoirs, it is desirable to provide new methods and equipment to safely drill, complete, produce, and intervene on HPHT wells over the economic life of the well.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
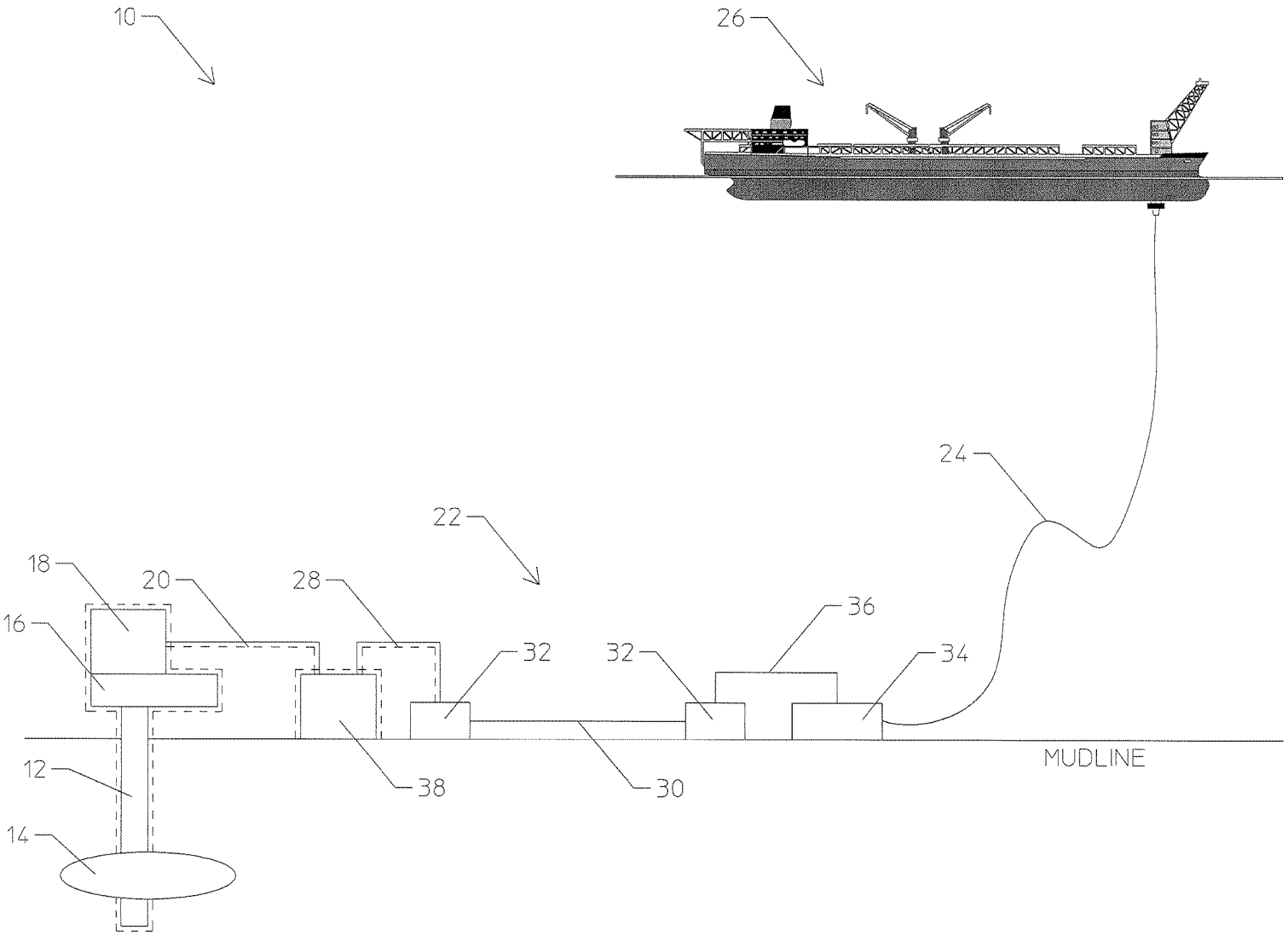
FIG. 1 is a schematic block diagram of a subsea system used to produce fluids from a subsea HPHT well, in accordance with an embodiment of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to a subsea system and an associated method for completion, production, and intervention on high pressure and/or high temperature (HPHT) subsea wells. The system may be utilized for transporting oil, gas, and other fluids from a subsea well to an offshore production facility.

Most offshore wells that are currently being produced operate at pressures less than and up to approximately 10,000 psi. However, it is now desirable to produce hydrocarbons from subsea HPHT wells that operate within pressure ranges of up to approximately 15,000 psi, up to approximately 20,000 psi, or higher pressures. This would enable the development of subsea reservoirs that are not currently accessible. Operating in such high pressure and/or high temperature environments may involve the use of new and advanced technology, enhanced seals, new types of materials (e.g., materials with higher strengths and properties that do not degrade significantly at high temperatures, pressures, and various drilling and production fluids), and other improvements to increase the pressure rating of various subsea system components.

The disclosed embodiments provide a full top-to-bottom subsea system that can be used to drill, complete, produce, and perform interventions on HPHT subsea wells. The disclosed systems and methods involve the use of at least one controlled multiple barrier system, such as a high integrity pipeline protection system (HIPPS), incorporated into the subsea system to divide the system into two sections. The sections on either side of the disclosed barrier may be rated for different pressures, temperatures and/or flow rates. For example, the first section (upstream of the barrier) is rated for operating at pressures/temperatures/flow rates up to a first (higher) threshold. At least a portion of the second section (downstream of the barrier) is rated for operating at pressures/temperatures/flow rates up to a second (lower) threshold. The disclosed subsea production system methodology, which uses the HIPPS or other barrier to divide the system components between two pressure ratings, may allow for enhanced development of HPHT reservoirs.

Turning now to the drawings, FIG. 1 schematically illustrates a subsea production system 10 in accordance with an embodiment of the present disclosure. The production system 10 may include, for example, a wellhead system 12 targeting a high pressure and/or high temperature (HPHT) production zone 14 within a reservoir. The system 10 may also include a production tubing head spool (THS) 16 connected to the top of the wellhead 12, a subsea production tree 18 connected above the THS 16, and a well jumper 20 leading from the tree 18 to a flowline system 22. Further, the system 10 may include a riser 24 connected from the flowline system 22 to a topsides production facility 26, and a subsea umbilical (not shown) to monitor and inject chemicals as required into the wellbore and subsea pipeline facilities.

In the illustrated embodiment, the flowline system 22 may include a fortified well jumper 28, a flowline 30 with opposing flowline pipeline end terminations/manifolds (PLETs/PLEMs) 32 at opposite ends thereof, a riser PLET 34, and a flowline jumper 36 for coupling the flowline PLET/PLEM 32 to the riser PLET 34. The term "fortified well jumper" refers to a well jumper that is fully rated for the higher pressures/temperatures/flow rates expected from downhole (e.g., pressures up to 15,000 psi, 20,000 psi, or more). The various PLETs described herein may generally function as end points for associated flowlines. It should be noted that other numbers and relative arrangements of such flowline components, end terminals, manifolds, and jumpers may be used in other embodiments of the flowline system 22. For example, in some embodiments, a flowline pipeline end manifold (PLEM) may be substituted for one or both of the illustrated flowline PLETs 32, enabling multiple production wells to feed into the same production facility 26 via the riser 24.

The system 10 of FIG. 1 is designed for the production of hydrocarbons from the subsea HPHT zone 14. In general, the HPHT zone 14 may be categorized as having a subsea mudline pressure above approximately 15,000 psi and/or temperatures greater than approximately 350 degrees F. To develop such HPHT reservoirs 14, the disclosed system 10 generally includes one or more components that form a pressure barrier 38 disposed upstream of the flowline system 22. In the illustrated embodiment, for example, the barrier 38 is disposed just downstream of the production tree 18 and is fluidly coupled to the tree 18 via the well jumper 20. It should be noted that in the present disclosure, the term "upstream" generally refers to the direction facing the subsea wellhead 12, while the term "downstream" generally refers to the direction facing the topsides production facility 26.

In some embodiments, the barrier 38 may include a high integrity pipeline protection system (HIPPS). The HIPPS module may be a skid-mounted system that features a series of chokes, sensors, and valves between the wellhead 12 and the flowline system 22, and a control module. The control module is used to control the pressure of production fluids and other fluids let through the barrier in a particular direction, and to isolate an upstream pressure source from the downstream facilities (e.g., 26). In the illustrated embodiment, the barrier 38 may be provided as a separate skid unit with a control module for keeping the pressure of production fluids below a desired threshold as the production fluid moves downstream from the reservoir 14 to the topside production facility 26. As described below, other embodiments of the barrier 38 may feature valves, chokes, and/or control components that are spread throughout the system 10, or integrated into a more upstream component of the system 10.

The barrier 38, and all equipment upstream of the barrier 38, may be rated for a maximum pressure, temperature, or flow rate that is equal to or greater than the maximum pressure, temperature, or flow rate of the HPHT reservoir 14. This maximum pressure may include the highest expected reservoir shut-in pressure plus an additional margin, which may be for chemical injection into the subsea production system 10 and subsea wellbore or for operation of the surface-controlled subsurface safety valve (SCSSV). The subsea system components that are rated for the higher pressure/temperature/flow rate are indicated by dashed lines in FIG. 1. In present embodiments, these components may be rated for a maximum pressure of beyond 15,000 psi and/or rated for temperatures of at least approximately 350 degrees F.

Downstream of the barrier 38, one or more pieces of wellbore equipment may be rated for a maximum pressure, temperature, or flow rate that is less than that of the upstream (higher rated) system components. This lower pressure/temperature/flow rating is indicated by solid (not dashed) lines in the illustrated embodiment. In some embodiments, these components may be rated for pressure of up to approximately 7,000 psi to 10,000 psi. In other embodiments, these components may be rated for pressures of up to approximately 15,000 psi. The barrier 38 may be used to protect this downstream equipment from the relatively higher fluid pressures experienced upstream, thereby allowing more technically and commercially feasible flowline (22) and riser (24) equipment to be utilized. For example, the riser 24 and certain flowline equipment may be constructed from cheaper materials, may utilize less complex seals, and may require less costly development than the higher rated upstream components.

Figure 2:
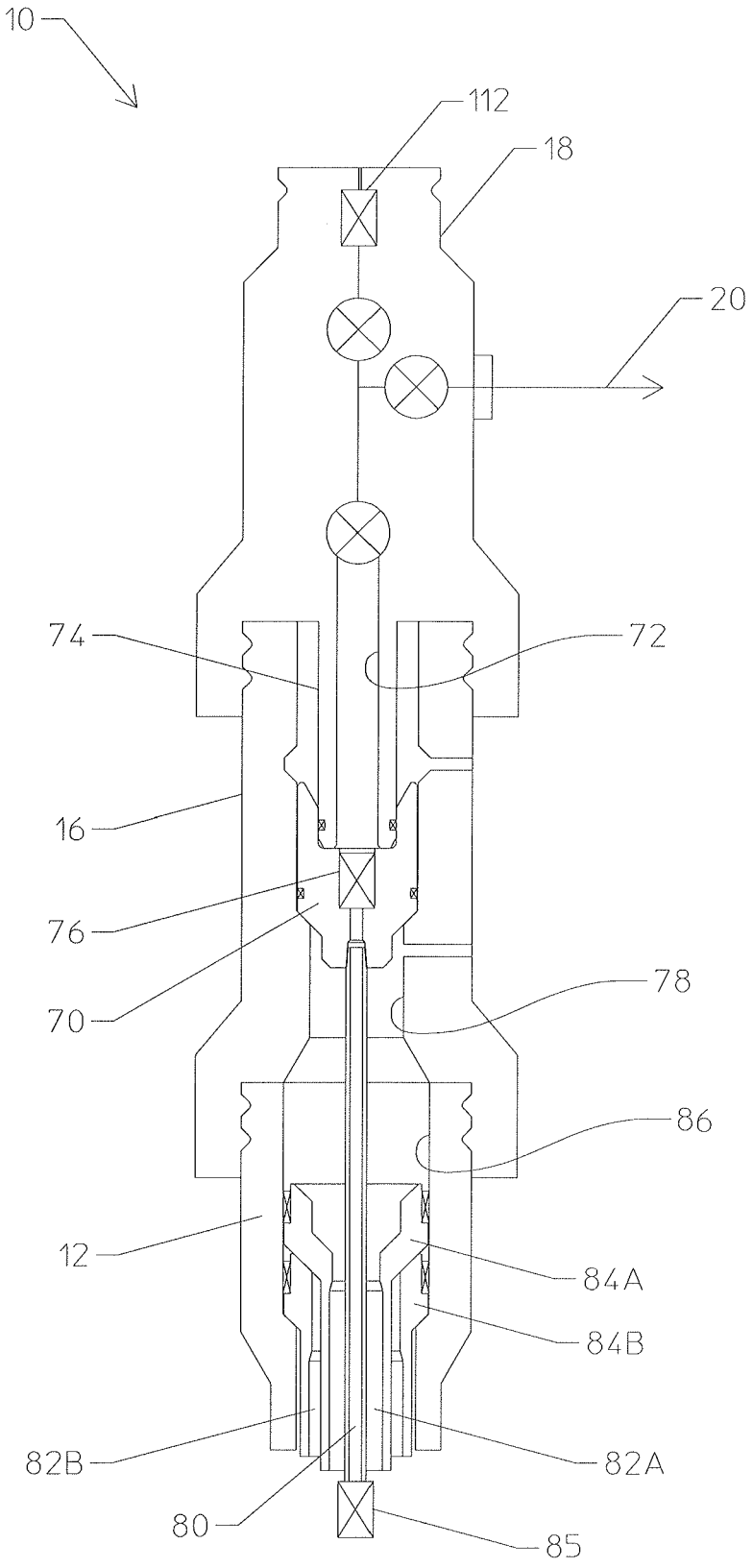
FIG. 2 is a schematic cutaway view of components of a subsea production system used to produce fluids from a subsea HPHT well, in accordance with an embodiment of the present disclosure.

Having generally described the components that make up the disclosed HPHT subsea system 10, a method describing various completion, production, and intervention processes associated with the subsea system 10 will be provided. In association with the steps of this method, FIG. 2 illustrates a more detailed view of certain components of the subsea production system 10 of FIG. 1 at a point during a construction or workover phase. The subsea production system 10 depicted in FIG. 2 may include the wellhead 12, the THS 16, and the production tree 18. The production tree 18 may include various valves for fluidly coupling a vertical bore 72 formed through the tree 18 to one or more downstream flowpaths (e.g., well jumper 20). The tree 18 may be sealed to the THS 16 using seals not shown. The THS 16 may be connected to and sealed against the wellhead 12.

In addition, the subsea system 10 may include a tubing hanger 70. As shown, the tubing hanger 70 is fluidly coupled to the bore 72 of the tree 18. In the illustrated embodiment, an isolation sleeve 74 may seal the tree 18 to the tubing hanger 70. A tubing hanger plug 76 may be removably placed within the tubing hanger 70 at one or more times throughout the completion and workover processes described below. The tubing hanger 70 may be landed in a shoulder in bore 78 of the THS 16 and sealed to the THS 16, as shown. The tubing hanger 70 may suspend a tubing string 80 into and through the wellhead 12. The wellhead 12, likewise, may suspend one or more casing strings (e.g., inner casing string 82A and outer casing string 82B) from corresponding hangers (e.g., hanger 84A and hanger 84B). As illustrated, a surface controlled subsurface safety valve (SCSSV) 85 may be disposed within a portion of the tubing string 80 extending from the wellhead 12.

Referring now to the components shown in both FIGS. 1 and 2, the following method may be utilized during construction and operation of the disclosed subsea production system 10. In an embodiment, the method may include installing a low pressure conductor housing (not shown) on the sea floor and landing the high pressure wellhead 12 in the conductor housing. The method then involves running and securing a blowout preventer (BOP), not shown, to the top of the wellhead 12. The BOP may function as a fail-safe that can be used to seal the wellbore in response to undesirable pressure fluctuations downhole during drilling and completion operations. The BOP includes a vertically oriented bore through which drill pipe, casing, production tubing, and other equipment may be lowered.

Once the BOP is in place, one or more casing strings 82 may be lowered through the BOP and the high pressure wellhead 12, such that the casing strings 82 extend into the wellbore. As mentioned above, the casing strings 82 may be landed in the wellhead 12 via corresponding hangers 84 that are disposed in a sealing engagement within a bore 86 of the wellhead 12. Once the casing strings 82 are landed, the method may include retrieving the BOP and installing the THS 16 onto the top of the wellhead 12. After positioning and sealing the THS 16 onto the wellhead 12, the BOP may be run and connected to the top of the THS 16. As discussed below, in some embodiments, a THS may not be utilized in the subsea system 10. In that case, the step of installing the THS would be eliminated.

At this point, the method may include landing the tubing hanger 70 and associated tubing 80 proximate the wellhead 12. This may involve connecting the tubing hanger 70 (and associated tubing 80) through a BOP completion riser system, which includes a subsea test tree (SSTT) and landing string. The BOP completion riser system may be a specialized tool that can be lowered into the THS 16 and used to deploy, actuate, and/or remove one or more pieces of equipment. The method may further include running the tubing hanger 70 (and associated tubing 80) through the BOP completion riser system and landing the tubing hanger 70 in a sealing engagement within the bore 78 of the THS 16. In some embodiments, the method may include installing the plug 76 within the tubing hanger 70 via a wireline that is lowered from the surface through the BOP completion riser system. The plug 76 may function to seal the inner bore of the tubing hanger 76. Then the BOP completion riser system may be disengaged from the landed tubing hanger 70 and retrieved to the surface. The BOP may then be removed from the THS 16 and retrieved to the surface. In embodiments where no THS is used, the method may include landing the tubing hanger 70 directly within the wellhead 12. This may still be accomplished using the BOP completion riser system described above, which may be lowered into the wellhead 12.

The method may further include landing the production tree 18 above the wellhead 12 and making up the completion riser system onto the internal profile of the production tree 18 after the tree 18 has been landed. In some embodiments, the production tree 18 may be landed onto the THS 16. The tree 18 may be sealed onto the THS 16 and against the tubing hanger 70 via the isolation sleeve 74. In other embodiments where a THS in not used, the production tree 18 may be landed directly onto the wellhead 12. The method may include retrieving the plug 76 from the tubing hanger 70 via the wireline. After retrieving the wireline plug 76, the method may include disconnecting the BOP and completion riser system from the tree 18 and retrieving them back to the surface. The method may then include installing a tree cap, which is not shown, onto the top of the production tree 18. Once assembled in this manner, the tree 18 may function to direct production fluids in a controlled manner from the wellbore.

Upon constructing the stack of the wellhead 12, optional THS 16, and tree 18 as described above, the method may include connecting the tree 18 to the barrier 38, for example a high-integrity pressure protection system (HIPPS) module, via the well jumper 20. Then the barrier 38 may be connected to the flowline 30 (or a gather manifold 32) via the fortified jumper 28. The term "fortified jumper" refers to a well jumper that is rated for the higher pressures expected from downhole (e.g., up to 15,000 psi, 20,000 psi, or more). The flowline 30 and/or manifold 32 may then be connected to the riser 24 via the flowline jumper 36, for example. The riser 24 may be connected to the floating production facility 26, as shown.

One or more subsea control components and/or umbilicals from the topsides facility 26 may be installed and connected to the subsea production equipment. The method then includes commissioning the subsea facility, and starting up production to flow back the well to the production facilities 26 for regulatory and data gathering purposes. Upon completion of the flowback, the subsea production system 10 may be controlled to commence normal production operations.

Over the life of the well, the completion riser system described above or a completion workover riser (CWOR) system may be used to lower equipment into the tree 18, THS 16, wellhead 12, or other components of the subsea system 10 to perform interventions as needed. In some embodiments, it may be possible to utilize existing intervention equipment that is rated for only up to 15,000 psi as the reservoir pressure declines throughout the productive life of the well.

It should be noted that the wellhead 12 used in the disclosed subsea system may be rated for maximum pressures beyond 15,000 psi. To that end, it may be desirable for the wellhead 12 to be sized larger than existing wellheads that are rated for lower pressures. For example, in the disclosed systems the wellhead 12 may include a mandrel with an outer diameter of approximately 35 inches. The larger mandrel diameter of the wellhead 12 used in the system 10 may enable fluid to flow through the wellhead 12 at greater pressures than would be available using smaller conventional wellheads. Additionally, the larger mandrel diameter of the wellhead 12 is capable of supporting larger external static loads (bending, tension, compression, shear, etc.) and more severe fatigue load spectrums that are generated in HPHT applications due to larger size BOPs, taller stacks, new rigs, dual gradient offsets, and so forth. In some embodiments, the wellhead 12 may feature an 18¾ inch nominal bore diameter. In such systems 10, the production components may be sized such that a nominal production bore of 3, 4, or 5 inches is provided, for example, in the tubing hanger 70, tree 18, and completion riser system/CWOR. However, other embodiments of the subsea system 10 may feature other sizes of wellheads 12 that are still rated for 20,000 psi or more.

The method described above represents one possible method for performing well drilling, completion, production, and intervention operations. Other methods may be utilized that eliminate, replace, or alter one or more of the steps described above, based on the physical layout of the subsea system 10. Some examples of such other embodiments of the system 10 will now be described.

In some embodiments, the subsea system 10 may include an additional fortified zone downstream of the HIPPS or other barrier 38. The term "fortified" refers to these system components being rated for relatively higher pressures (e.g., up to approximately 15,000 psi or 20,000 psi). The fortified zone may include, for example, a fully rated jumper (28), manifold (32), flowline (30), or combination thereof. This may provide a higher rated section of the flowline system 22 to allow for adequate response and closure time of the pressure barrier valve(s) of barrier 38, in the event of a downstream pipeline blockage or hydrate formation. The fortified zone length may be determined by analyzing the dynamic pressure/temperature response within the flowline during a high pressure/temperature event and sizing the fortified length to provide an adequate response time for the barrier 38 to activate (close) before the high pressure/temperature fluid reaches the lower rated downstream pipeline.

Figure 3A:
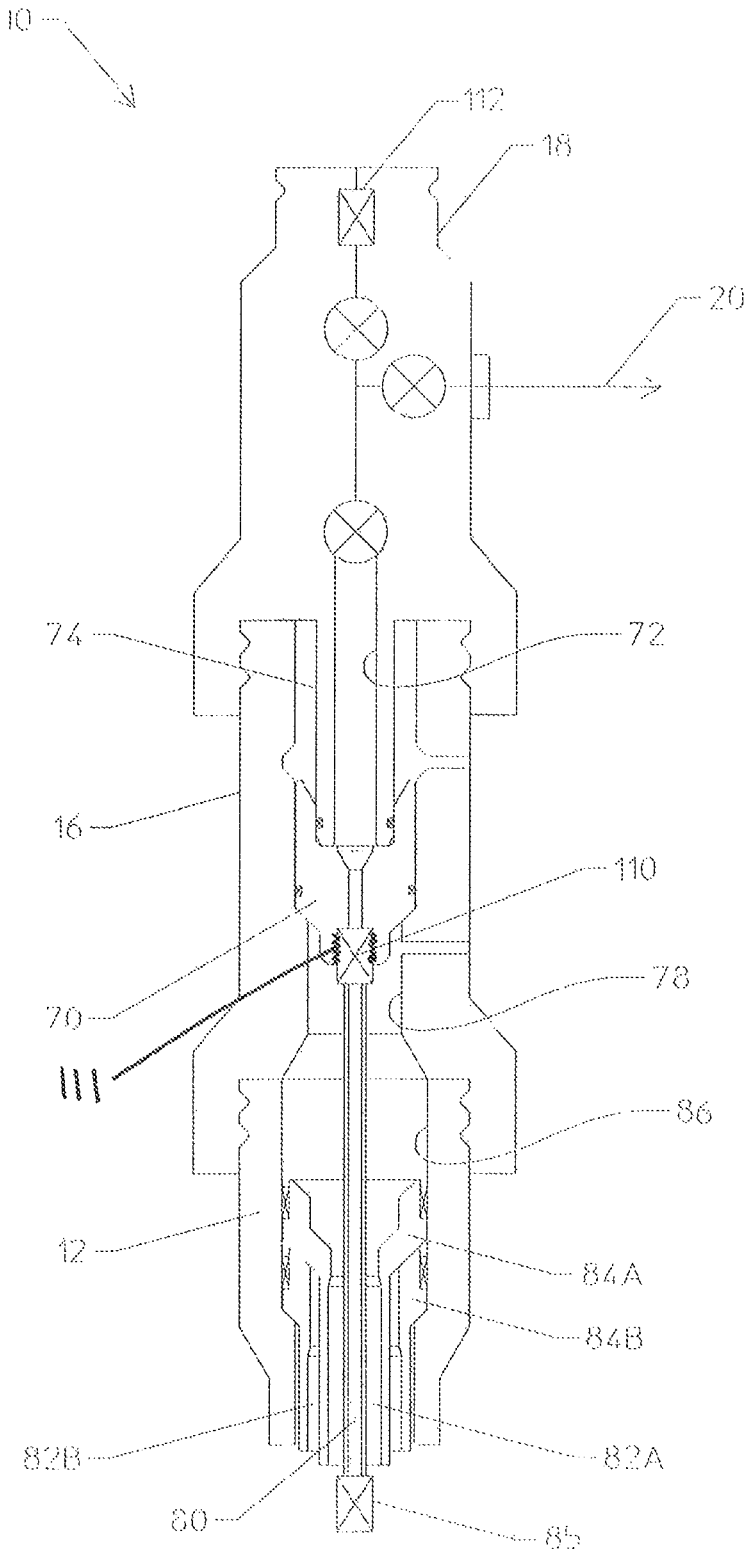
FIGS. 3A-3D are schematic cutaway views of components of a subsea production system used to produce fluids from a subsea HPHT well, in accordance with an embodiment of the present disclosure.
Figure 3B:
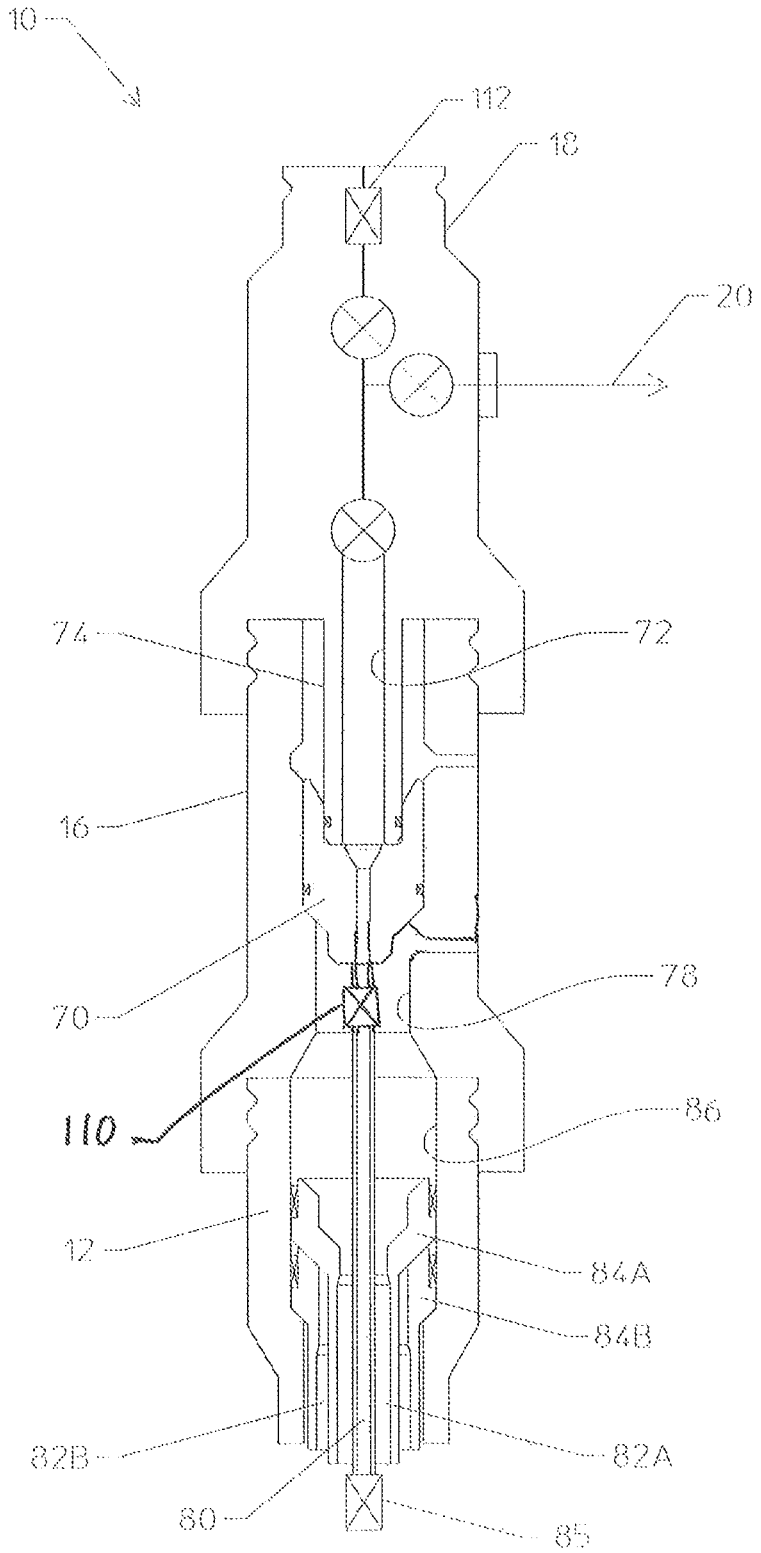
Figure 3C:
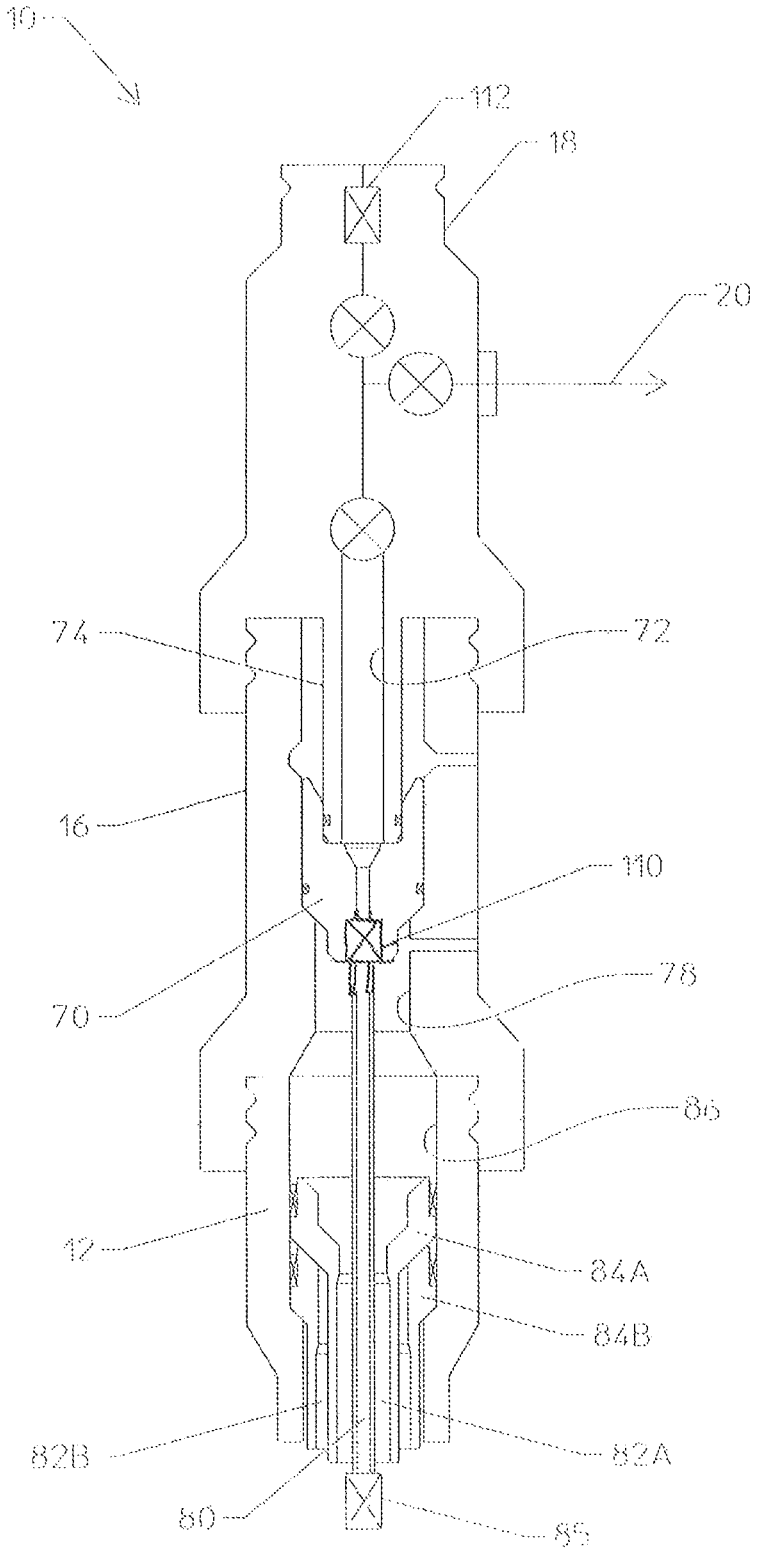

FIGS. 3A-3D illustrate another embodiment of certain components of the subsea production system 10. Similar to FIG. 2, the illustrated subsea system 10 may generally include the wellhead 12, the THS 16, the production tree 18, and the tubing hanger 70. In the embodiments of FIGS. 3A-3C, the subsea system 10 may also include the THS 16, while the embodiment of FIG. 3D does not have a THS. In these embodiments, the system 10 also may include a remotely operated secondary barrier valve 110, which is in line with and upstream of the tubing hanger 70. This valve 110 may be actuated to selectively create a barrier by closing off the inner diameter of the production tubing string 80 and/or tubing hanger bore. The valve 110 may be a flapper valve, a ball valve, a gate valve, a shuttle valve, or any other desired type of remotely actuable valve. The valve 110 may be disposed at or below the tubing hanger 70, and the valve 110 may be actuated remotely via signals from the topsides facility at the surface.

The valve 110 may be installed in its position at or below the tubing hanger 70 prior to the tubing hanger assembly being brought to the well site. In some embodiments, as shown in FIG. 3A, the valve 110 may include a threaded portion 111 designed to thread directly into the bottom of the tubing hanger 70. In other embodiments, as shown in FIG. 3B, the valve 110 may be threaded onto or integrated with a portion of the tubing string 80 extending beneath the tubing hanger 70. In embodiments where the valve 110 is disposed below the tubing hanger 70, the valve 110 may be designed similar to the production tubing SCSSV 85. In still other embodiments, as shown in FIG. 3C, the valve 110 may be integrated directly into the tubing hanger 70. That is, the valve 110 may be built into the tubing hanger 70 during the initial construction of the tubing hanger 70. As shown, the production tree 18 may also be equipped with a valve 112 that provides an additional barrier above the swab in the production bore.

Figure 3D:
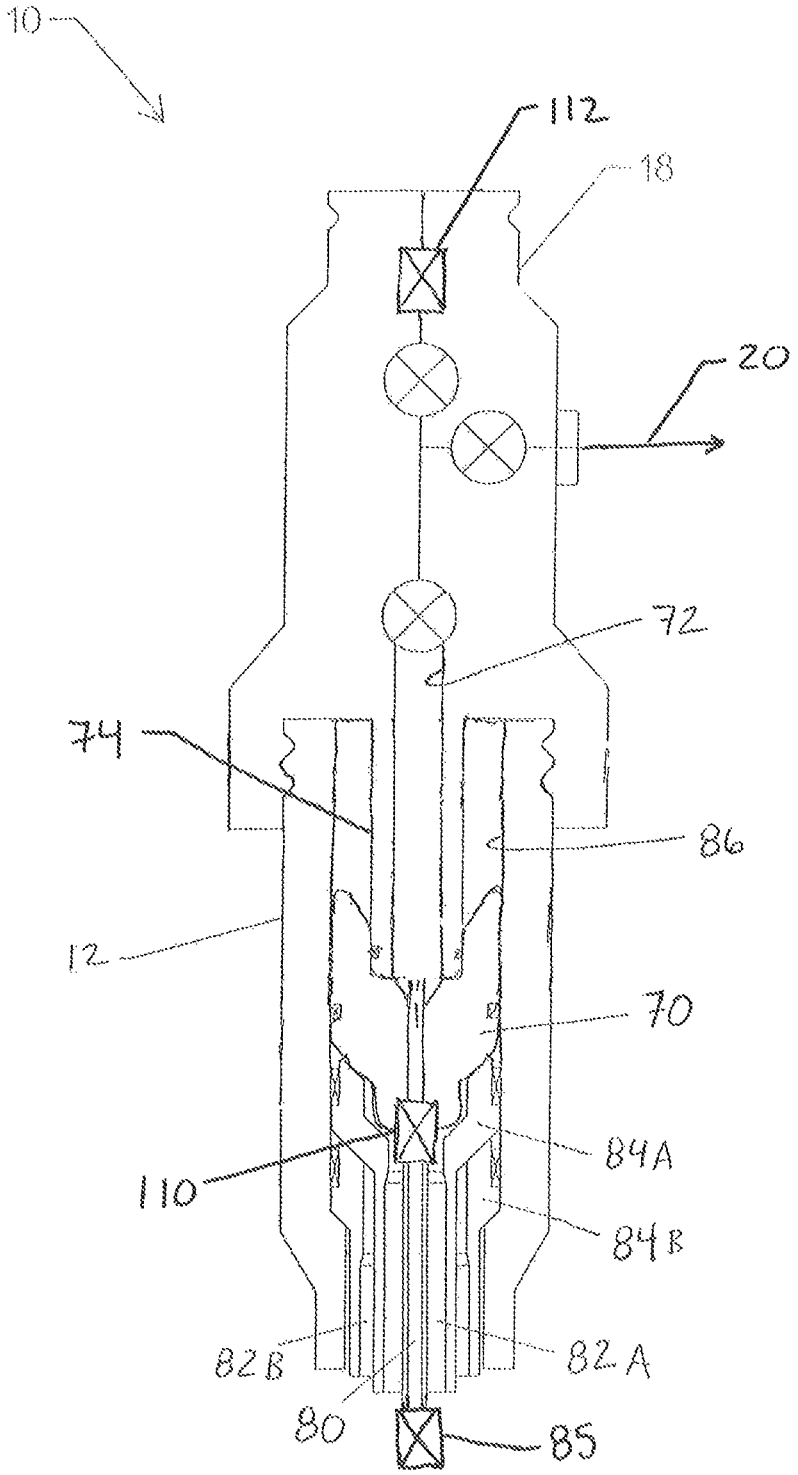

As shown in FIG. 3D, the secondary barrier valve 110 may also be utilized in embodiments of the subsea system 10 that do not include a THS. In such embodiments, the wellhead 12 may include specially designed seals and other components that enable the wellhead 12 to function in the high pressure high temperature environment. In this embodiment, the tubing hanger 70 may be landed directly into the wellhead 12, above the casing hangers 84. As discussed above with reference to FIGS. 3A-3C, the secondary barrier valve 110 may be threaded to the tubing hanger 70, formed integral with the tubing hanger 70, or attached to or integrated with the tubing string 80 below.

Installation of the subsea system 10 of FIG. 3D is similar to that which was described in detail above with reference to FIGS. 1 and 2, except that instead of installing the THS on the wellhead 12 and landing the tubing hanger 70 in the THS, the method includes simply landing the tubing hanger 70 within the wellhead 12, and then landing the production tree 18 onto the wellhead 12.

The pre-installed valve 110 may be particularly suitable for use during the construction and workover phases of the subsea system 10. First, the valve 110 may be pre-set to the desired open or closed position as the tubing hanger 70 is run into and landed in the THS 16. The valve 110 can then be actuated open or closed remotely, without requiring a designated wireline trip. That is, a topsides operator can simply select a control command to actuate the pre-installed valve 110, instead of installing a new plug (e.g., 76 of FIG. 2) or valve. This allows the valve 110 to be remotely closed without a separate plug (e.g., 76 from FIG. 2) being run via wireline and installed into the tubing hanger 70. In this manner, landing the tubing hanger 70 and closing the inner diameter of the tubing string 80 becomes a one-trip operation. Similarly, the valve 110 may be remotely opened so that there is no need to run a wireline for retrieving a plug (e.g., 76 of FIG. 2) from the tubing hanger 70. This may further allow for running and installing the production tree 18 via a wireline cable, instead of using the completion riser system or CWOR as described above. In addition, the valve 110 may be left in the open position within the tubing hanger 70 throughout production operations so that, in the event that a workover is desired, the valve 110 may be simply actuated closed from above, without having to run a plug.

In addition to eliminating certain installation/retrieval trips, the valve 110 may function as a redundant safety valve at certain times during the construction of the system 10. Once the valve 110 is installed along with the tubing hanger 70, it may operate similar to a back-up SCSSV. This back-up valve function may be particularly desirable during the workover phase before the tree 18 and/or the barrier 38 are attached to the system components. At this time, the valve 110 may provide some risk reduction prior to and while the other pressure/flow control components (e.g., tree 18, barrier 38) are being installed.

Figure 4:
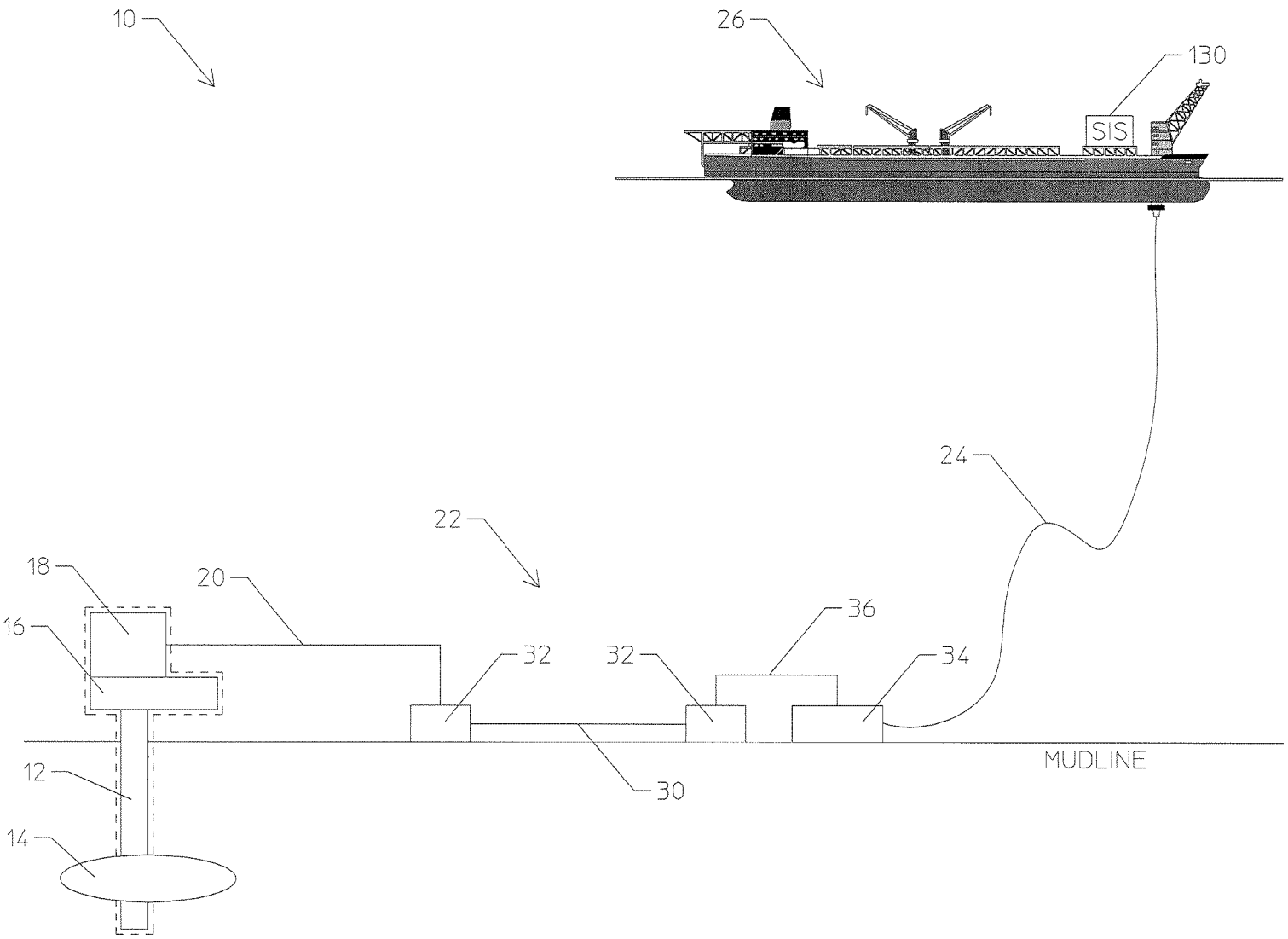
FIG. 4 is a schematic block diagram of a subsea system used to produce fluids from a subsea HPHT well, in accordance with an embodiment of the present disclosure.

FIG. 4 illustrates an embodiment of the subsea system 10 that does not include a HIPPS module (e.g., 38 of FIG. 1) for providing a barrier between differently rated components of the system 10. Instead, this embodiment shows the production tree 18 directly coupled to the flowline 30 via a well jumper 20. This system 10 may be particularly suited for use in field conditions where the maximum reservoir pressure of the reservoir 14 is less than approximately 15,000 psi, but certain well operations are expected to increase the mudline pressure to above 15,000 psi. For example, the well operations may include bullheading and/or chemical injection into the wellbore during shut-in or well safe-out operations, thereby raising the pressure through certain subsea system components (e.g., wellhead 12, tree 18, and umbilical equipment) to an excess of 15,000 psi.

For this scenario, a fully rated flowline system 22 and riser system 24 may be utilized downstream of the subsea production tree 18. That is, the equipment downstream of the production tree 18 may be rated for a pressure that is equal to the maximum reservoir pressure (i.e., less than 15,000 psi). This effectively eliminates the need for the HIPPS barrier valves described above. The wellhead 12, THS 16, and tree 18, however, may be rated at a pressure equal to or greater than the reservoir pressure plus an expected well operating pressure margin (i.e., greater than 15,000 psi). This higher pressure rating is indicated in FIG. 4 via dashed lines.

Overpressure protection of the lower rated downstream equipment (22, 24) due to chemical injection into the wellbore may be provided via a Safety Instrumented System (SIS) 130 located on the topsides facility 26, used in conjunction with subsea valve interlocks provided via a subsea control system (not shown). The subsea valve interlocks may include a plurality of valves disposed along flowlines about the wellhead 12, tree 16, or other subsea production equipment. The Safety Instrumented System 130 may control these valves together to maintain a desired subsea operational state (i.e., maintaining a lower pressure downstream of the wellhead 12). In this manner, the subsea valve interlocks may function as the pressure barrier in this system 10.

Figure 5:
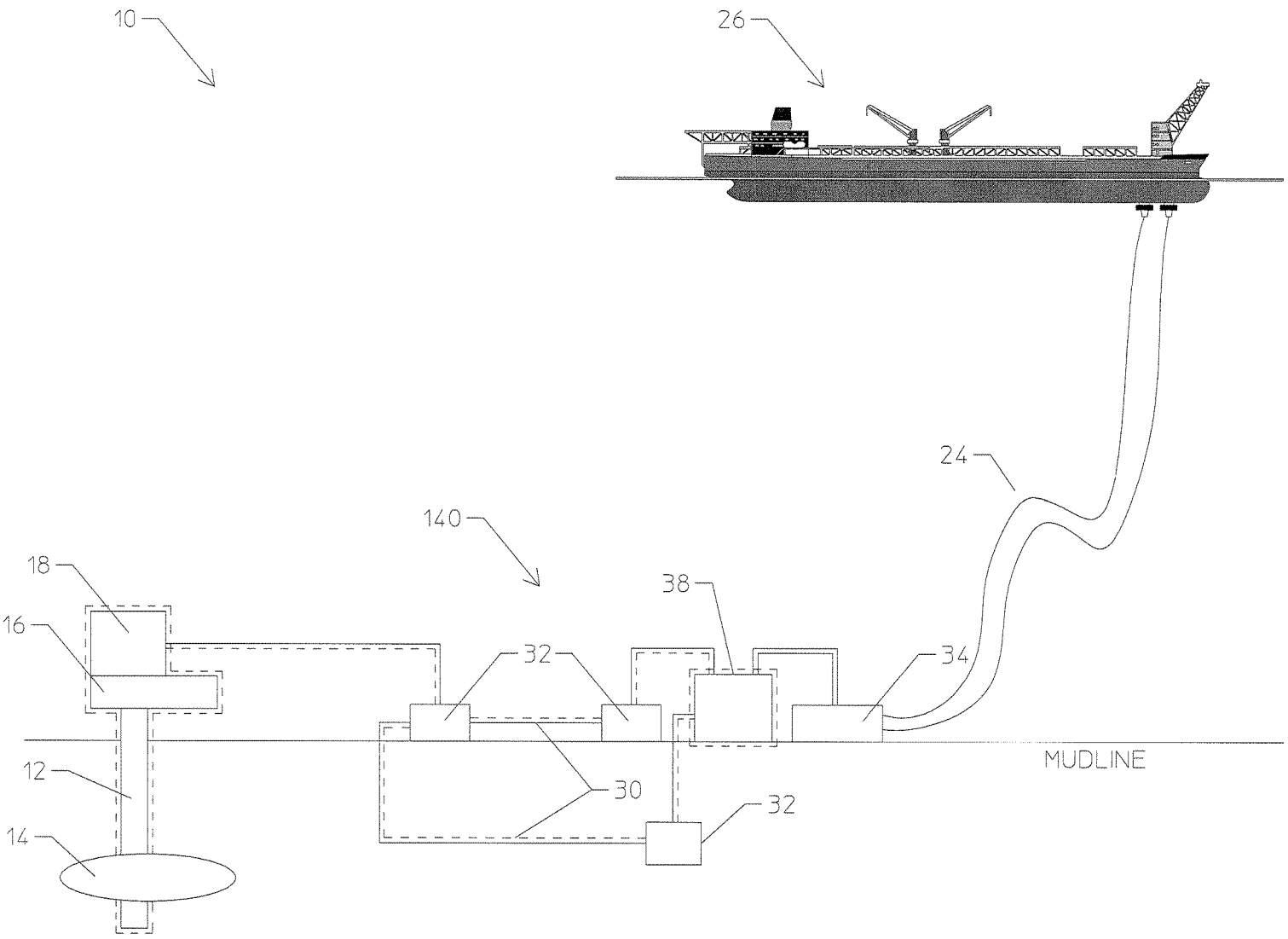
FIG. 5 is a schematic block diagram of a subsea system used to produce fluids from a subsea HPHT well, in accordance with an embodiment of the present disclosure.

Still other arrangements of the subsea system 10 may provide a desired pressure barrier between higher rated and lower rated subsea equipment for use in production of HPHT wells. For example, some embodiments of the subsea system 10 may feature a looped flowline system 140 (as shown in FIG. 5) or a dual flowline/riser system, where the pressure barrier (e.g., HIPPS) 38 is located at the base of the production riser 24. This configuration may allow for continuous production of hydrocarbons and eliminate production deferrals during required regulatory testing of the HIPPS barrier valves 38. For example, a first set of valves in the HIPPS module 38 disposed along one side of the looped flowline/riser system may be tested while a second set of valves in the HIPPS module 38 are operated to maintain a pressure barrier for production fluids moving through the second side of the looped flowline/riser system.

Figure 6:
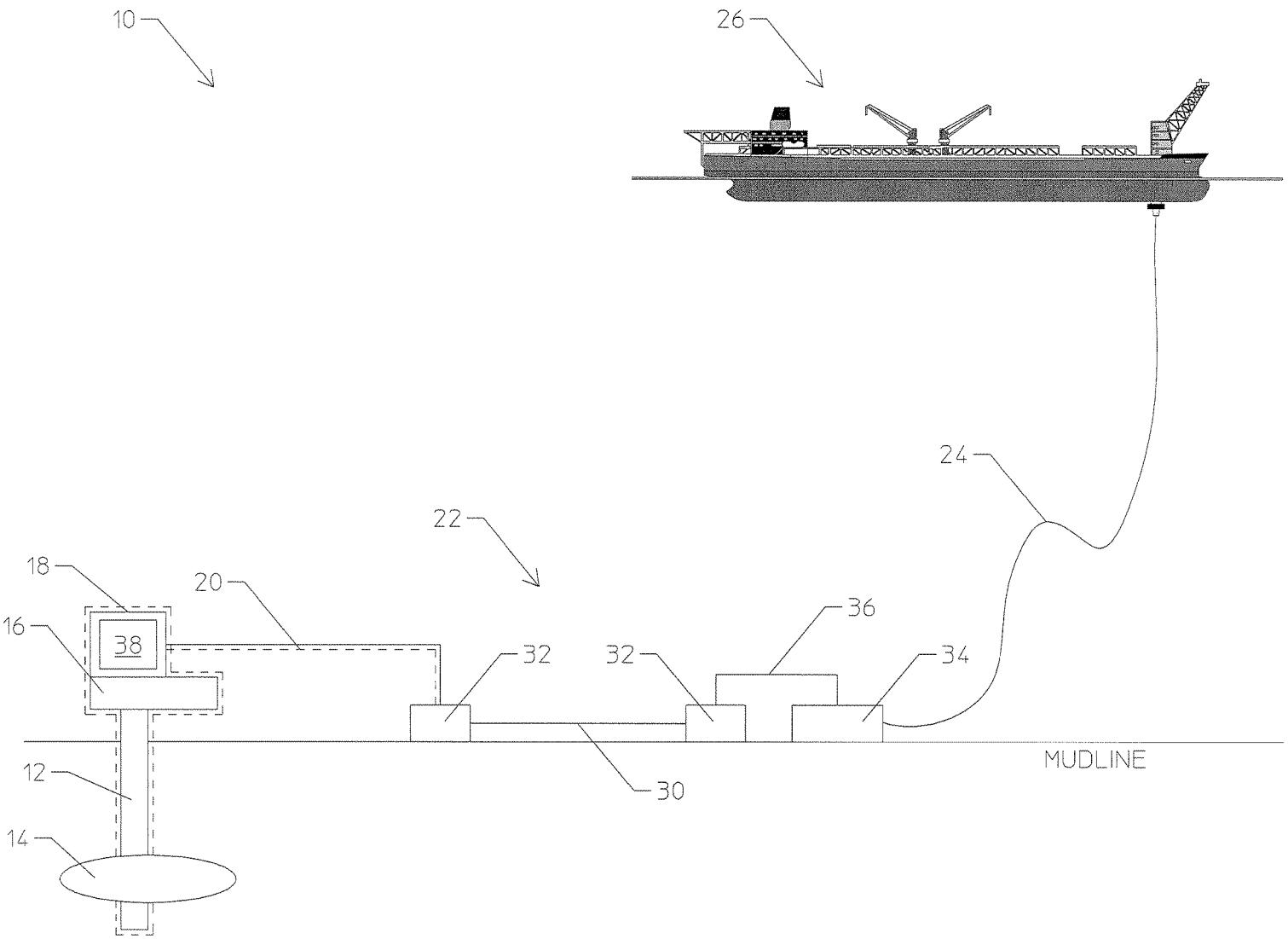
FIG. 6 is a schematic block diagram of a subsea system used to produce fluids from a subsea HPHT well, in accordance with an embodiment of the present disclosure.

In other embodiments, the subsea system 10 may feature a pressure barrier 38 disposed within the flow loop of the subsea production tree 18 (as shown in FIG. 6) or the THS 16. For example, the pressure barrier 38 may take the form of a HIPPS module that is coupled directly to the production tree 18. This positioning of the barrier 38 may eliminate the installation of a separate HIPPS module during the subsea completion process. Incorporating the barrier 38 into the production tree 18 in this manner may enable unique HIPPS configurations of the pressure barrier 38 that make use of existing functionality within the production tree 18. This may simplify or reduce the overall hardware requirements within the HIPPS module, as compared to an entirely standalone HIPPS pressure barrier (e.g., FIG. 1). For example, the HIPPS module may utilize valves, a bypass/test circuit, or communication components (for communicating with topsides equipment) that are already present in the production tree 18 to establish the pressure barrier 38. The HIPPS module used to form the barrier 38 of FIG. 6 may be a retrievable module that can be selectively separated from the production tree 18 at a desired time. That way, the HIPPS module may be retrieved to the surface and replaced with a non-HIPPS module that is rated for lower pressures at a later date when the HIPPS pressure barrier 38 is no longer required due to a decline of the reservoir pressure. When the HIPPS module is incorporated into the production tree 18 to form the pressure barrier 38, certain configurations of the HIPPS components and the production tree components may utilized to allow for startup of the well without tripping the HIPPS valves.

In some embodiments, the pressure barrier 38 may include a common design of interfacing hardware that can be used to couple the pressure barrier 38 to different components of the subsea system. For example, the same design for the pressure barrier 38 may be used to interface with equipment including the production tree 18 (e.g., FIG. 6) or similar subsea structures such as manifolds (PLETs/PLEMs) 32 (e.g., FIGS. 1 and 5).

Figure 7:
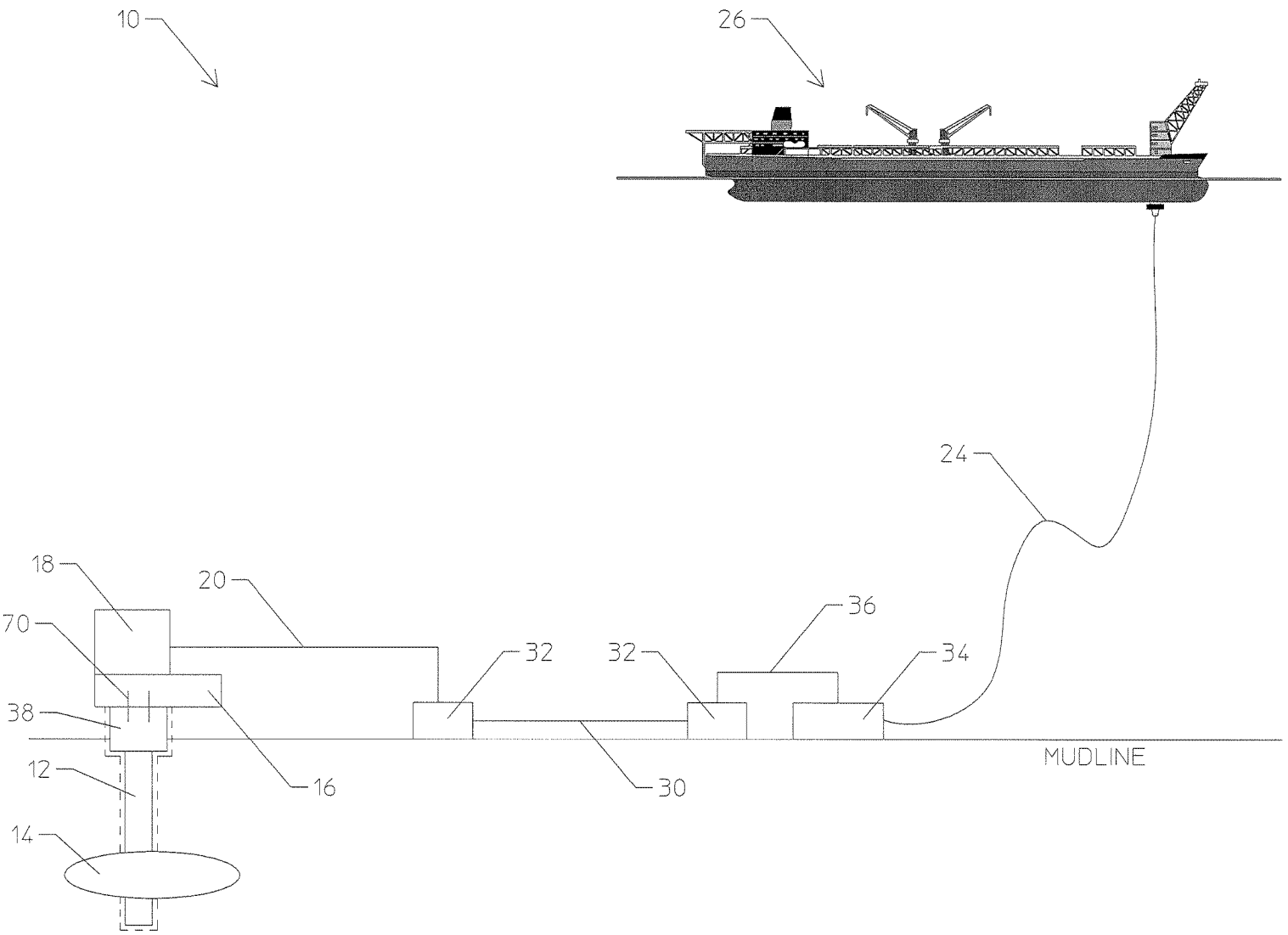
FIG. 7 is a schematic block diagram of a subsea system used to produce fluids from a subsea HPHT well, in accordance with an embodiment of the present disclosure.
Figure 8:
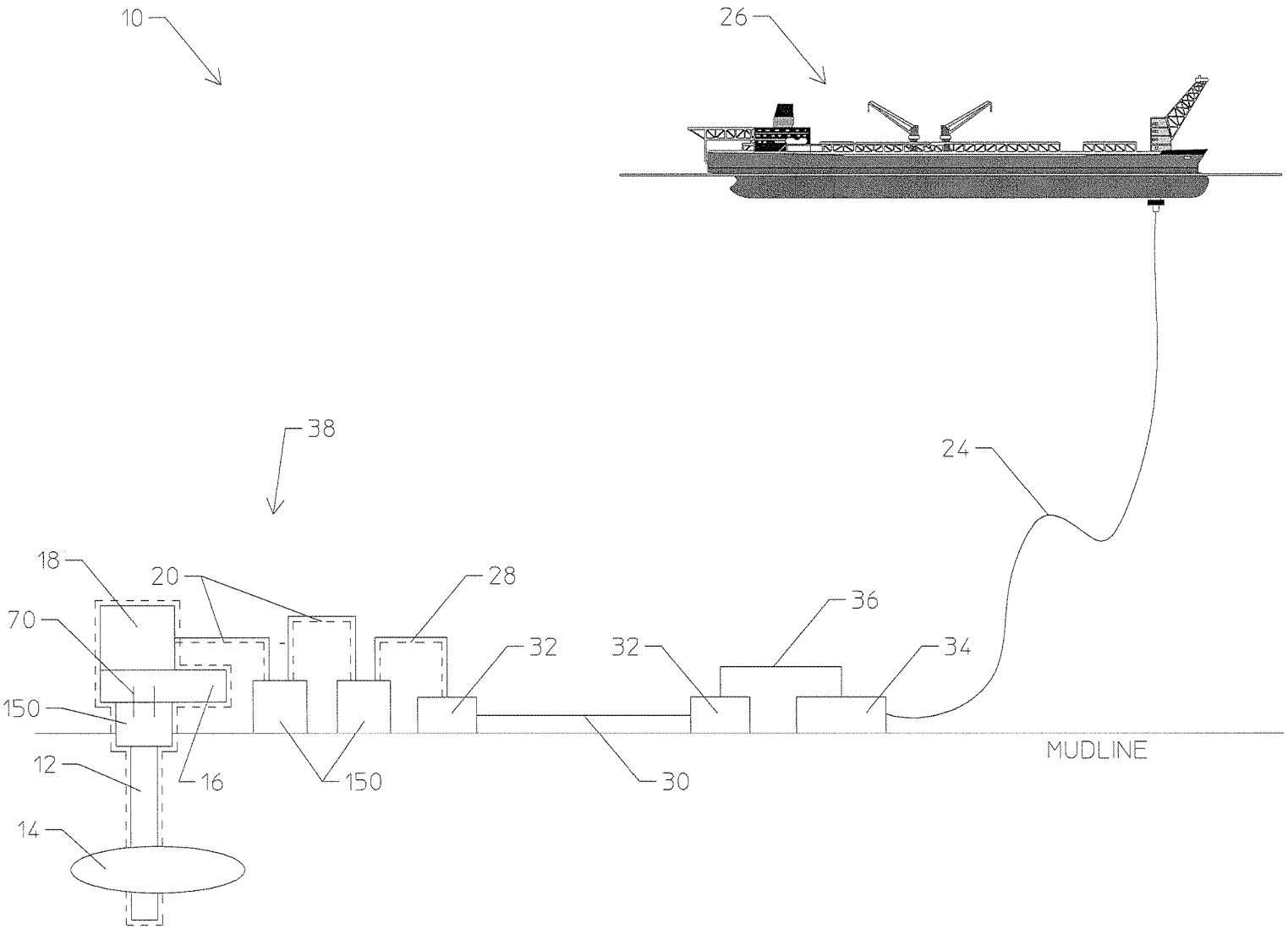
FIG. 8 is a schematic block diagram of a subsea system used to produce fluids from a subsea HPHT well, in accordance with an embodiment of the present disclosure.

As shown in FIG. 7, in other embodiments the pressure barrier 38 may be located within or upstream of the high pressure wellhead (12) housing and/or tubing hanger 70. In still other embodiments, the pressure barrier 38 between higher and lower pressure rated equipment may be provided as a more distributed HIPPS. As shown in FIG. 8, for example, the subsea system 10 may include a modular pressure barrier 38 (HIPPS) disposed throughout the wellhead 12 and completion system through the use of various chokes 150. The chokes 150, as shown, may be located upstream of the tubing hanger 70 and downstream of the completion equipment (i.e., THS 16, tree 18). As noted above, various other arrangements of barrier components 38 may be provided at different locations to separate the fully HPHT rated components of the system 10 from more conventional equipment (e.g., riser 24, flowline system 22) that are rated for lower pressures.

Although the present disclosure and its advantages have been described in detail, it should be understood that various changes, substitutions and alterations can be made herein without departing from the spirit and scope of the disclosure as defined by the following claims.

What is claimed is:

1. A method, comprising:

installing a subsea production system comprising a wellhead, a tubing hanger, a production tree, a riser, and a subsea flowline system by:

landing the tubing hanger proximate the wellhead, wherein a secondary barrier valve is disposed within the tubing hanger;

installing the production tree above the wellhead downstream of the tubing hanger with the secondary barrier valve being in a closed position;

remotely actuating the secondary barrier valve from the closed position to an open position after installing the production tree;

coupling the production tree to at least one barrier located downstream of the tubing hanger, wherein the at least one barrier comprises a high integrity pipeline protection system (HIPPS) module; and coupling the production tree to the riser via the subsea flowline system;

producing hydrocarbons from a subsea reservoir to a topsides production facility via the subsea production system; and controlling the at least one barrier in the subsea production system to control a pressure of fluid flowing from components of the subsea production system located upstream of the barrier to components of the subsea production system located downstream of the barrier.

2. The method of claim 1, wherein remotely actuating the secondary barrier valve closes off an inner diameter of a production tubing string extending from the tubing hanger, a bore of the tubing hanger, or both.

3. The method of claim 1, wherein the secondary barrier valve comprises a threaded portion that is threaded directly into a bottom of the tubing hanger.

4. The method of claim 1, wherein the secondary barrier valve is threaded onto or integrated with a portion of a tubing string extending from the tubing hanger.

5. The method of claim 1, wherein the secondary barrier valve is integrated directly into the tubing hanger.

6. The method of claim 1, wherein the secondary barrier valve comprises a flapper valve, a ball valve, a gate valve, or a shuttle valve.

7. The method of claim 1, wherein installing the production tree comprises lowering the production tree toward the wellhead and installing the production tree via a wireline cable when the secondary barrier valve is in the closed position.

8. The method of claim 1, wherein the subsea reservoir comprises a high pressure and/or high temperature reservoir having a maximum reservoir pressure in excess of approximately 15,000 psi, a maximum temperature in excess of approximately 350 degrees F., or both.

9. The method of claim 1, wherein at least one of the components located downstream of the barrier is rated for a first maximum pressure, temperature, or flow rate, and wherein all of the components located upstream of the barrier are rated for a second maximum pressure, temperature, or flow rate that is greater than the first maximum pressure, temperature, or flow rate.

10. The method of claim 1, further comprising:
installing a tubing head spool (THS) on the wellhead;
landing the tubing hanger within the THS; and
installing the production tree on the THS.

11. The method of claim 1, further comprising:
landing the tubing hanger within the wellhead; and
installing the production tree on the wellhead.

12. A subsea production system, comprising:
a high pressure subsea wellhead;
a tubing hanger landed proximate the wellhead;
a production tree disposed above the wellhead and downstream of the tubing hanger;
a riser;
a subsea flowline system coupled between the production tree and the riser;
at least one barrier, wherein the barrier is located downstream of the tubing hanger, providing a pressure barrier that controls pressure of fluid flowing from components of the subsea production system located upstream of the barrier to components of the subsea production system located downstream of the barrier, wherein the at least one barrier comprises a high integrity pipeline protection system (HIPPS) module; and
a secondary barrier valve disposed within the tubing hanger, wherein the secondary barrier valve is remotely actuable between a closed position and an open position.

13. The subsea production system of claim 12, wherein remotely actuating the secondary barrier valve closes off an inner diameter of a production tubing string extending from the tubing hanger, a bore of the tubing hanger, or both.

14. The subsea production system of claim 12, wherein the secondary barrier valve comprises a threaded portion that is threaded directly into a bottom of the tubing hanger.

15. The subsea production system of claim 12, wherein the secondary barrier valve is threaded onto or integrated with a portion of a tubing string extending from the tubing hanger.

16. The subsea production system of claim 12, wherein the secondary barrier valve is integrated directly into the tubing hanger.

17. The subsea production system of claim 12, wherein the secondary barrier valve comprises a flapper valve, a ball valve, a gate valve, or a shuttle valve.

18. The subsea production system of claim 12, wherein at least one of the components located downstream of the barrier is rated for a first maximum pressure, temperature, or flow rate, and wherein all of the components located upstream of the barrier are rated for a second maximum pressure, temperature, or flow rate that is greater than the first maximum pressure, temperature, or flow rate.

* * * * *